US005899161A

United States Patent [19]

Sell et al.

[11] Patent Number: 5,899,161

[45] Date of Patent: May 4, 1999

[54] SHIP WITH PLANE AREA ELEMENTS WHICH EXTEND HORIZONTALLY AND ARE LOCATED IN THE HULL OF THE SHIP

[75] Inventors: Günther Sell, Norden; Hermann Herkens; Johann Wilts, both of Emden, all of Germany

[73] Assignee: Thyssen Nordseewerke GmbH, Emden, Germany

[21] Appl. No.: 08/705,691

[22] Filed: Aug. 29, 1996

[30] Foreign Application Priority Data

Aug. 31, 1995 [DE] Germany ..... 195 32 107

[51] Int. Cl.[6] ..... B63B 25/00

[52] U.S. Cl. ..... 114/72; 114/75

[58] Field of Search ..... 114/72, 75, 260; 108/53.1, 91

[56] References Cited

U.S. PATENT DOCUMENTS

| | | | |
|---|---|---|---|
| 3,327,654 | 6/1967 | Duncan et al. | 108/53.1 |
| 3,434,445 | 3/1969 | Crumley | 114/72 |
| 3,448,711 | 6/1969 | Mulholland et al. | 114/260 |
| 3,722,449 | 3/1973 | Goldman | 114/260 |

FOREIGN PATENT DOCUMENTS

| | | | |
|---|---|---|---|
| 0470714 | 2/1992 | European Pat. Off. . | |
| 0473357 | 3/1992 | European Pat. Off. . | |
| 2238588 | 2/1973 | Germany . | |
| 3305323 | 8/1984 | Germany . | |
| 3704225 | 8/1987 | Germany . | |
| 728424 | 4/1955 | United Kingdom | 108/53.1 |

*Primary Examiner*—Sherman Basinger
*Attorney, Agent, or Firm*—Niles H. Ljungman & Associates

[57] ABSTRACT

A ship which has supporting columns which run vertically and are located in the hull of the ship, as well as at least one flat, rectangular area element which extends horizontally and is supported on at least one of these support columns, in which the supporting columns are located at some distance from the corner points of the rectangular area element.

20 Claims, 9 Drawing Sheets

SHIP WITH PLANE AREA ELEMENTS WHICH EXTEND HORIZONTALLY AND ARE LOCATED IN THE HULL OF THE SHIP

BACKGROUND OF THE INVENTION

1. Field of the Invention

The present invention relates to a ship which has supporting columns which run vertically and are located in the hull of the ship, as well as at least one area element, which is mounted on the supporting columns, extends horizontally, and has corner points.

2. Background Information

In the construction of cargo ships and warships, it is necessary to provide the interior of the hull of the ship with area elements which extend horizontally, thereby creating surfaces for stowing the cargo being carried or fastening the ship's own equipment.

Known measures for creating the above-mentioned areas for stowing or fastening cargo or equipment have several disadvantages, including the requirement that the structure of the ship must be adapted to the area elements which are to be installed, because the size of the area elements cannot be modified after they have been fabricated, nor can they be adapted to the space conditions in the hull of the ship.

OBJECT OF THE INVENTION

An object of the present invention is to improve the profitability of shipbuilding, and in particular to make it possible to flexibly and economically install area elements in the hull of a ship, whereby it may be subsequently possible to adapt the area elements to the space conditions in the hull of the ship.

SUMMARY OF THE INVENTION

The present invention teaches that this object can be achieved if the supporting columns are located at some distance from the corner points of the area element.

In contrast to known construction principles used in shipbuilding, the supporting columns claimed by the invention are no longer located at the corner points of the rectangular area elements, but at some distance from these corner points. In this manner, a number of important advantages are achieved:

Since the area elements extend with their corner points beyond the supporting columns, these areas can be modified or trimmed when the area elements are installed in the hull of the ship, which makes it possible to adapt the area elements to the space conditions in the hull of the ship.

Since the supporting columns are offset inward in relation to an area element, and the outside edges of the area element can be fastened either to other area elements, to the hull of the ship or to the deck, the total number of supporting columns required is less.

When there are a number of area elements adjacent to one another in a horizontal plane, as in the prior art, no more than four supporting columns parallel to one another are in direct contact with the corner points of the area elements. Since the corner points are the only areas in which four area elements are adjacent to one another, and as claimed by the invention, there are no supporting columns in these areas, the invention teaches that when a plurality of area elements are located in a horizontal plane, a maximum of two supporting columns are adjacent to one another, which results in a reduction in the amount of space required for the supporting columns.

The measure claimed by the invention on one hand can also reduce the complexity, expense and time required to adapt the area elements, and on the other hand can reduce the space requirement for the supporting columns as well as the number of supporting columns required.

One advantage of the construction claimed by the invention is that the ship's equipment and fittings can be installed both on the upper sides and on the undersides of the area elements. For this purpose, the area elements need not necessarily be flat. For example, the area elements can also have steps, inclined portions, holes, usable cavities, etc.

In one preferred embodiment of the invention, the area element can be mounted on the supporting column in the lower half of the column, in which case the area element is in particular attached at a height preferably of approximately ⅓ of the total height of the supporting columns. In this case, the supporting columns can extend through the area element, or can be fastened to the area elements on the underside or on the upper side of the area elements. This construction method makes it possible to achieve a particularly stable overall system in which, for example, a plurality of area elements, including the supporting columns corresponding to them, can be located one above the other with some distance between them, whereby, for example, the top or bottom ends of the supporting columns can be realized so that they are coupled to the bottom or top ends respectively of other supporting columns.

In one alternative embodiment of the invention it is also possible to mount the area element on the top or bottom ends of the supporting columns, so that the supporting columns extend either only downward from the area element or only upward from the area element.

The height of the supporting column which holds the area element can preferably be between about 1 m and about 5 m, preferably between about 2 m and about 4 m, and in particular approximately about 3 m. Any other height of the supporting columns is also conceivable, whereby the invention teaches that it is advantageous that the height of the supporting columns and thus the distance between the area elements which are above one another can be adjusted by a corresponding selection of the length of the supporting column.

The supporting columns are formed, for example, by a preferably rectangular structural shape, the dimensions of which are preferably between about 100 mm×100 mm and about 300 mm×300 mm, in particular approximately 200 mm×200 mm. Alternatively, the supporting columns can also be realized in the shape of I-beams.

The distance between the individual supporting columns which correspond to an area element is preferably between about 1 m and about 5 m, for example, in particular between about 2 m and about 4 m, and in particular approximately 3 m.

To reinforce and stabilize the area element, a plurality of deck girders which run horizontally and are parallel to one another at some distance from one another can be located on the underside of the area element, whereby the distance between neighboring deck girders can be between about 0.5 m and about 1.5 m, for example, preferably between about 0.7 m and about 1.3 m, and in particular about 1 m.

The deck girders can thereby be formed by Holland-type bulb plates. Alternatively, it is also possible to fabricate the deck girders from I-beams.

In an additional preferred embodiment of the invention, some, or in particular all the edges of the area element can be connected with I-beams, whereby the connecting webs of the I-beams preferably run horizontally, and the transverse webs of the I-beams run vertically. In this manner, drainage can be created by the above-mentioned I-beam around each area element.

The present invention teaches that a particularly stable overall system can be obtained if the edges of the area element which are next to the hull of the ship or a deck are non-positively connected to the hull or the deck, at least in some areas. As a result of the connection between the lateral edges of the area element and the hull of the ship or a deck, a lateral fastening of the area element is achieved, so that horizontal forces which cannot be absorbed by the supporting columns can be transmitted into the hull of the ship or into the corresponding deck. The lateral fastening of the area element thereby can make a significant contribution to its stability.

As a result of the use of the area elements claimed by the invention, for example, a very stable deck can be created, in particular by providing the above-mentioned deck girders so that they provide sufficient stability for any type of equipment. The system claimed by the invention is thereby characterized in particular by a low sensitivity to vibrations.

The area element described above with the corresponding supporting columns can be used in shipbuilding either as an individual, relatively large area element, or as a smaller area element which can be combined with other area elements to create a larger horizontal plane.

In the latter case, in the vicinity of a horizontal plane, there can be a plurality of area elements with their edges adjacent to one another.

The neighboring area elements with their edges adjacent to one another can thereby be non-positively connected to one another, in particular welded to one another, by means of these edges, thereby creating a stable horizontal surface.

In this embodiment, the supporting columns are preferably located in the vicinity of the edges, but at some distance from the corners of the area elements. That means that the area elements project beyond the supporting columns on two sides, and on these sides can be adapted to the specific space conditions available.

In particular, there are two or four supporting columns corresponding to each area element, whereby all the area elements can essentially be of the same size, for example. It is also possible, however, for each area element to correspond to one or three supporting columns.

The area elements can, for example, have an area between about 1 m×2 m and about 5 m×8 m, in particular between about 2 m×4 m and about 4 m×7 m, and preferably about 3 m×6 m.

In one advantageous embodiment of the invention, two supporting columns can be located on the longer edges of the area element, while the shorter edges of the area element have no supporting columns.

In this case, the distance between two supporting columns located on one of the longer edges of the area element can be approximately one-half of the length of the longer edge. In this case, there is a particularly uniform distribution of the load on the supporting columns if the distance between the end of one of the longer edges of the area element or one corner of the area element and the neighboring supporting column located on a longer edge of the area element can be approximately one-quarter of the length of the longer edge.

If, in this case, a plurality of area elements are located adjacent to one another, the supporting columns of all these area elements can form an essentially uniform grid, whereby between each two supporting columns, neighboring area elements come to lie in direct contact with one another. The distance between these pairs of supporting columns in the vicinity of the entire horizontal plane formed by the area elements essentially always equals approximately one-half of the length of the longer edge of an individual area element.

In the embodiment in which a plurality of area elements jointly form a horizontal plane, the above-mentioned deck girders are oriented in particular perpendicular to the longer edges of the area elements.

When the alternative embodiment is used, in which the horizontal plane is formed only by a single area element, this element can preferably be supported by a plurality of supporting columns arranged in a regular grid pattern.

In this embodiment, to make it possible to adapt the area element on all sides to the space conditions available in the hull of the ship, the supporting columns are preferably located at some distance from the edges of the area element, which means that the outer peripheral area of the area element is realized so that it does not contain any supporting columns. On account of the absence of supporting columns, it becomes possible to easily make adaptations or trim the area elements in this area.

In the latter case, it is advantageous if the distance between the edge of the rectangular area element and all of these neighboring supporting columns is between about 0.5 and about 2.5 m, in particular between about 1 m and about 1.5 m.

Even when a plurality of individual area elements are used, it is possible to locate the supporting columns at some distance from all the edges of the rectangular area element. The distance between the edges and the supporting columns must thereby be selected so that when the area elements are joined together, the result is preferably a regular grid pattern of supporting columns.

The invention teaches that it is advantageous if the individual area elements are equipped identically, for example, in different construction sites, and can then be installed in the hull of the ship either as a large module consisting of a plurality of area elements or as individual area elements. The area elements are preferably fabricated in a uniform modular grid, so that they can be fabricated outside the ship without regard to the equipment to be installed on them or the manner in which they must be fastened in the hull of the ship.

The supporting columns fastened to the area element are preferably realized so that, if necessary and in the event there is sufficient space in the hull of the ship, the area elements can be removed again.

The above discussed embodiments of the present invention will be described further hereinbelow with reference to the accompanying figures. When the word "invention" is used in this specification, the word "invention" includes "inventions", that is, the plural of "invention". By stating "invention", the Applicants do not in any way admit that the present application does not include more than one patentably and non-obviously distinct invention, and maintains that this application may include more than one patentably and non-obviously distinct invention. The Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

The invention is described in greater detail below, with reference to the embodiments illustrated in the accompanying drawings.

DESCRIPTION OF THE PREFERRED EMBODIMENT

Figure 1:
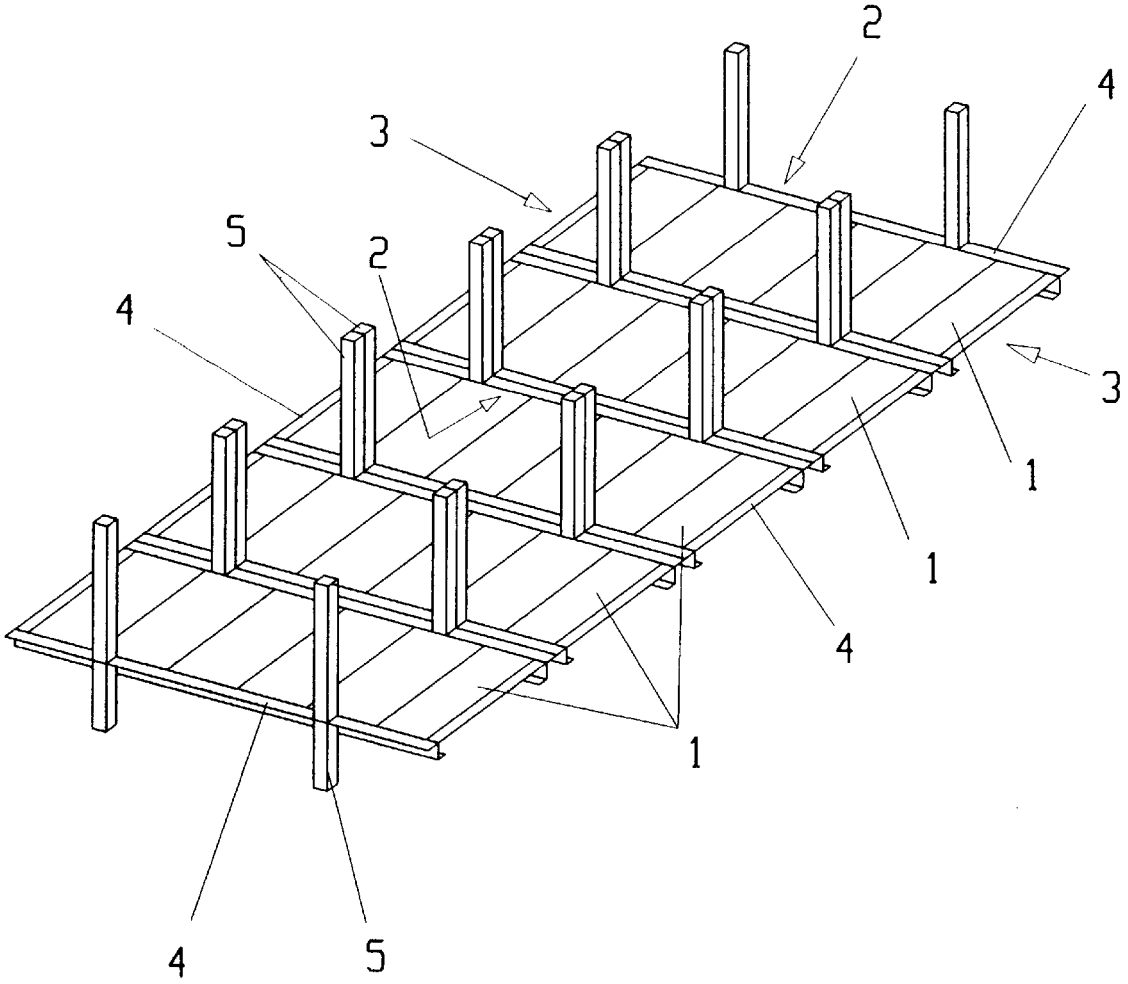
FIG. 1 is a perspective view of a plurality of area elements of a first type in a first configuration, located adjacent to one another in a horizontal plane.

FIG. 1 shows a total of five area elements 1, each of which is realized so that it is rectangular with two longer sides 2 opposite one another and two opposite shorter sides 3 opposite one another.

On sides 2, 3, the area elements 1 are connected to structural shapes 4, which, as illustrated in FIG. 1, can be realized in the form of Z-shaped profiles 4, for example.

By means of these profiles 4, the area elements 1 which are located next to one another are connected to one another, in particular welded to one another, by means of their longer sides 2.

Corresponding to each of the longer edges 2 of the area element 1 there are respectively two supporting columns 5.

The supporting columns 5 are thereby located on the longer edges 2 so that the distance between two supporting columns located on a longer edge 2 is equal to approximately one-half of the length of the longer edge 2. The distance between the end of the longer edge 2 and the neighboring supporting column 5 is thereby approximately one-fourth of the length of the longer edge 2.

The area elements 1 are mounted on the supporting columns 5 at a height of approximately ⅓ of the total height of the supporting columns 5, whereby the supporting columns 5 are connected to the profiles 4 of the longer edges 2 or extend through these profiles.

In the embodiment illustrated in FIG. 1, all the area elements 1 are oriented parallel to one another and are adjacent to one another by means of their longer edges 2.

Figure 2:
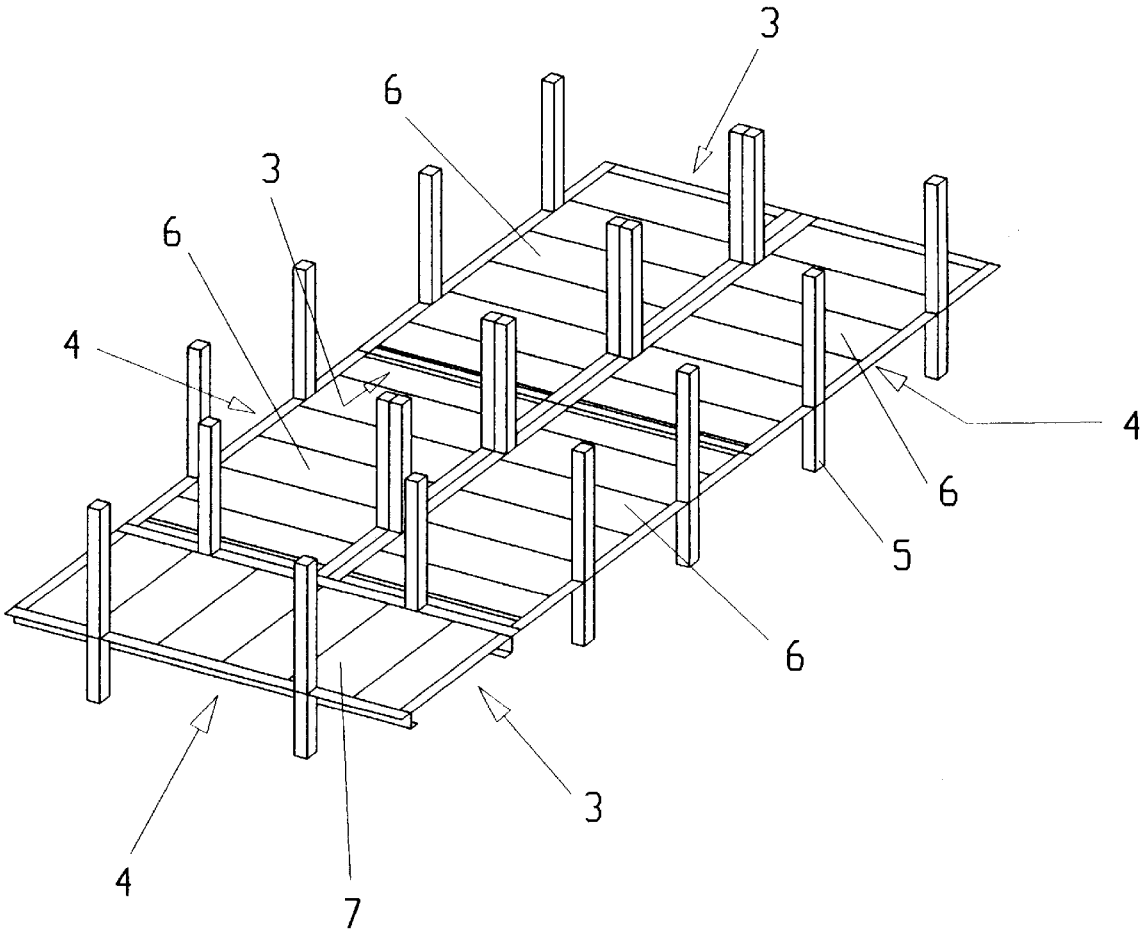
FIG. 2 is a perspective view of a plurality of area elements of the first type in a second configuration located adjacent to one another in a horizontal plane.

The embodiment illustrated in FIG. 2 also consists of five area elements 6, 7, which are realized in a manner which is identical to the area elements 1 illustrated in FIG. 1, but are oriented differently in relation to one another.

The four area elements 6 are located and oriented so that each of these area elements 6 is adjacent by means of one shorter edge 3 and one longer edge 4 respectively to a shorter edge 3 and a longer edge 4 of a neighboring area element. The four area elements 6 thereby result in a rectangular overall surface, the longer side of which is twice as long as a longer edge 4 of an area element 6 and the shorter side of which is twice as long as the shorter edge 3 of an area element 6.

In the area in which two longer edges 4 of the area element 6 are adjacent to one another, their supporting columns 5 form respective pairs of supporting columns of two supporting columns 5 which are directly adjacent to one another.

Since the supporting columns 5 as illustrated in FIG. 2 are at the same distance from the corner points of the area elements 6 as the supporting columns 5 illustrated in FIG. 1, the distance between the supporting columns 5 of one area element 6 should be the same as the distance between two supporting columns 5 of the neighboring area elements 6, which should result in a uniform distribution of the load on the supporting columns 5.

On a side of the total area formed by the surface elements 6 formed by two shorter edges 3, an additional area element 7 is located so that it is adjacent by means of one longer edge 4 to the above-mentioned side of the overall surface formed by the area elements 6.

It should be noted that the area element 7 is flush against the overall surface formed by the area element 6, which is made possible by the fact that the longer edge 4 of the area elements 6, 7 is twice as long as their shorter edge 3.

Figure 3:
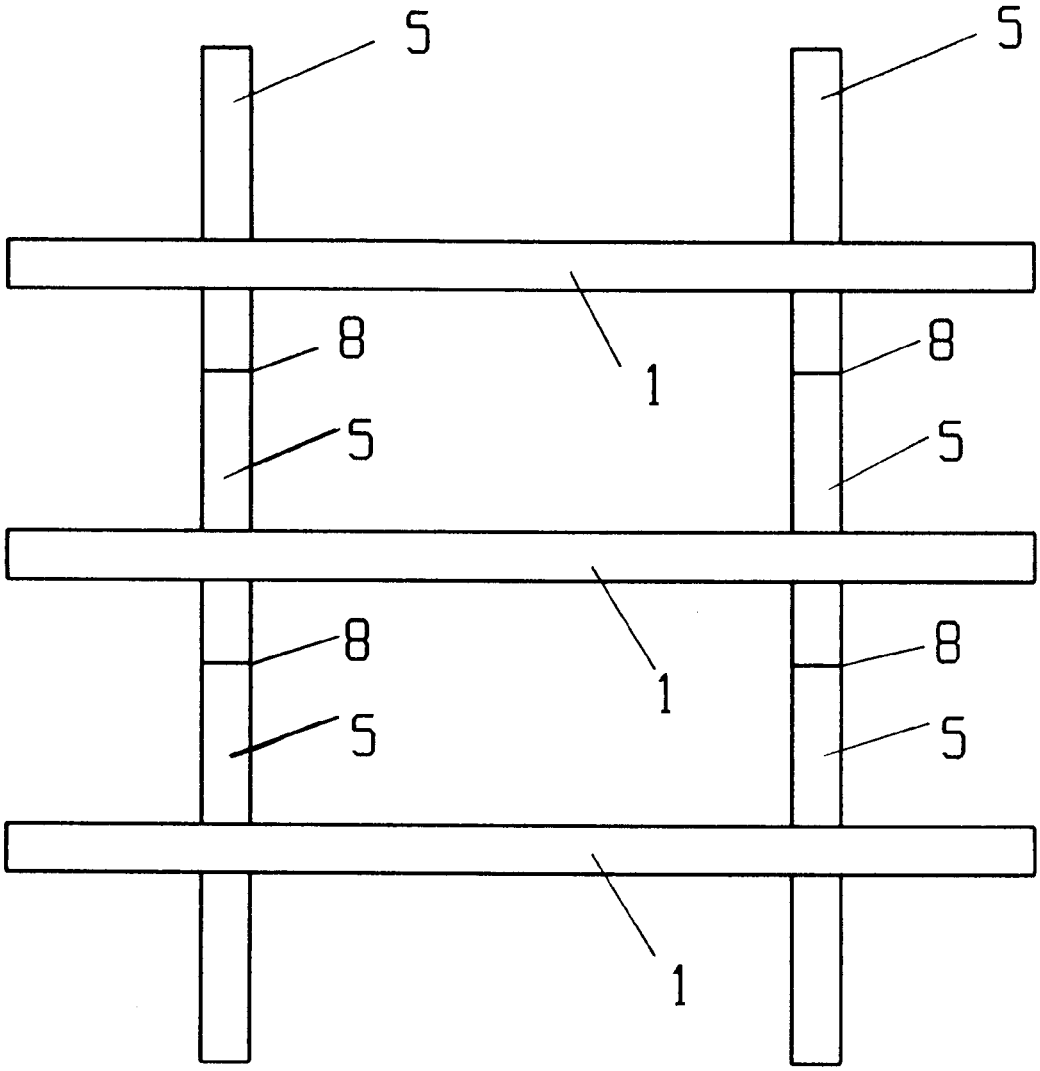
FIG. 3 is a section through several area elements of the first type located one above the other.

FIG. 3 shows a section through several area elements 1 as illustrated in FIG. 1, which including their corresponding supporting columns 5 are located one above the other and at some vertical distance from one another.

The top and bottom ends of the supporting columns 5 are thereby realized so that they can be connected to the bottom and top ends respectively of other supporting columns 5. The above-mentioned connection points are identified by the number 8 in FIG. 3.

As illustrated in FIG. 3, a plurality of levels located one above the other can be located inside the hull of a ship, and can be used either for the transport of cargo or for the fastening of parts of the ship's equipment.

Figure 4:
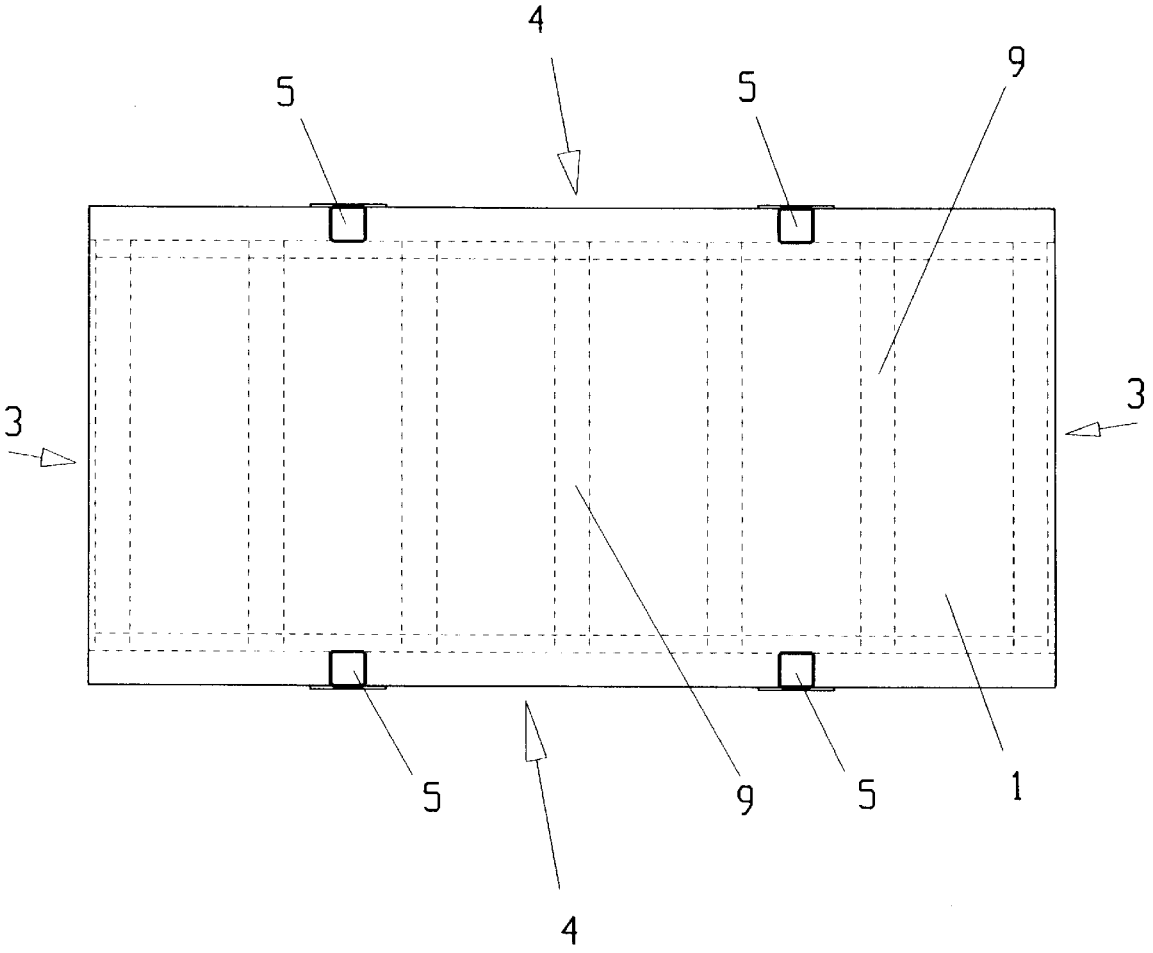
FIG. 4 is an overhead view of an area element as illustrated in FIGS. 1 to 3.

FIG. 4 is an overhead view of an area element as illustrated in FIG. 1 which has four supporting columns 5, whereby the area element 1 has two shorter sides 3 and two longer sides 4.

On the underside of the area element 1 there are a plurality of deck girders 9 which run parallel to the area element 1 and are located parallel to one another and at some distance from one another. The deck girders 9 are illustrated in broken lines in FIG. 4.

The deck girders 9 extend parallel to the shorter sides 3 and are perpendicular to the longer sides 4 of the area element 1. The deck girders 9 are essentially always at the same distance from one another, so that overall there is a regular distribution of the deck girders 9 over the area element 1, as a result of which there is a uniform distribution of forces on the deck girders 9.

Figure 5:
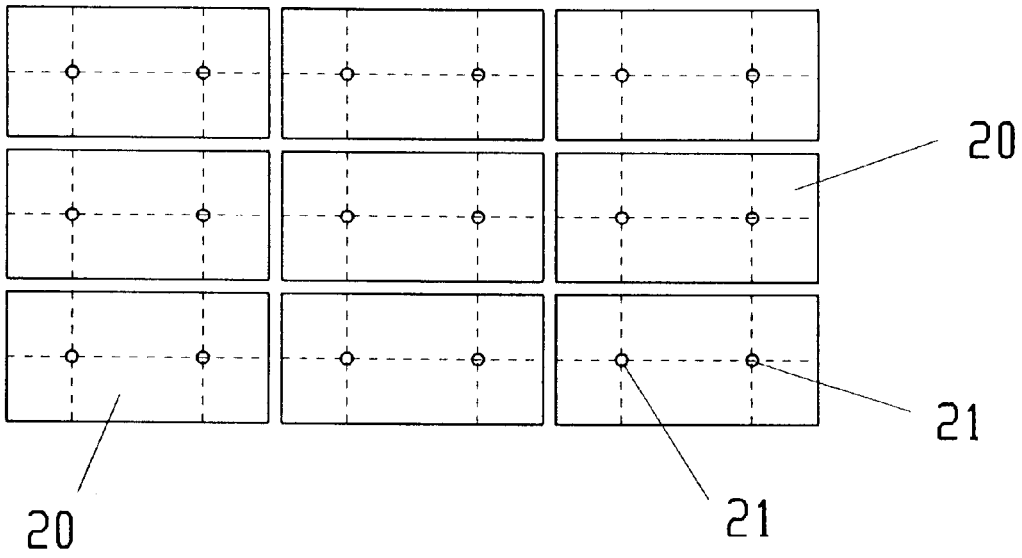
FIG. 5 is an overhead view of a plurality of area elements of a second type located adjacent to one another in a horizontal plane.

FIG. 5 shows an overhead view of a plurality of area elements 20 which are located adjacent to one another in a horizontal plane, whereby for each area element 20 there are two supporting columns 21.

The area elements 20 are rectangular, whereby the supporting columns 21 are located in the middle between the two longitudinal edges of the area elements 20; in other words, the distance between the supporting columns 21 and the one longitudinal edge of the area element 20 is exactly as great as the distance from the supporting columns 21 to the other longitudinal edge of the area element 20.

The distance from the supporting columns 21 to the respective neighboring shorter edge of the area element 20 is approximately ¼ of the length of the area element 20.

If it is further assumed that the area elements 20 are approximately twice as long as they are wide, then when a plurality of area elements 20 are arranged in a grid pattern as illustrated in FIG. 5, the supporting columns 21 will always be at a distance from one another which equals approximately one-half the length of the area elements 20, so that the supporting columns 21 are ultimately arranged in an essentially square grid pattern.

Figure 6:
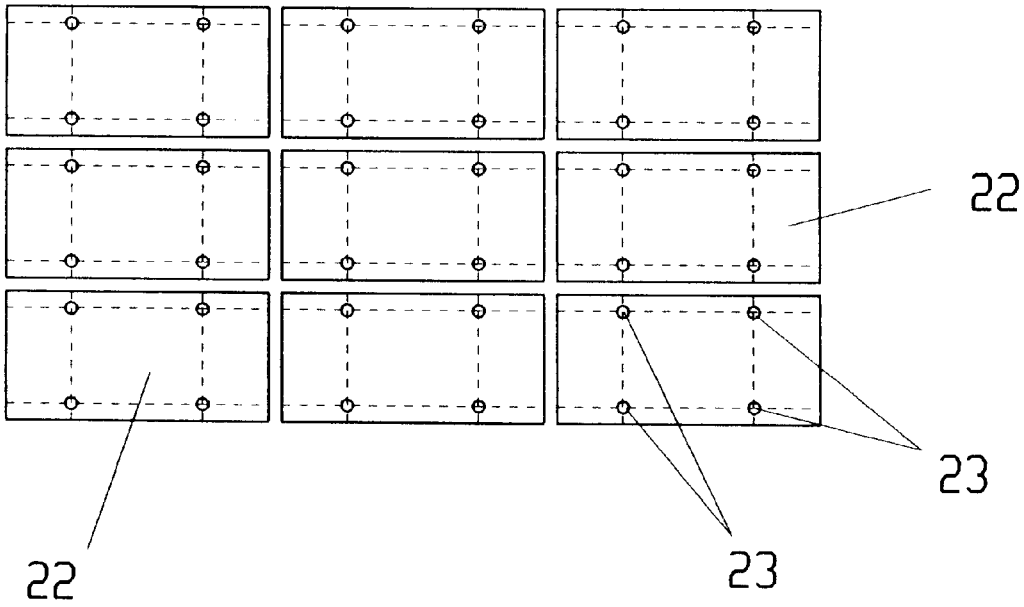
FIG. 6 is an overhead view of a plurality of area elements of a third type located adjacent to one another in a horizontal plane.

In the embodiment illustrated in FIG. 6, the area elements 22 are each provided with four supporting columns 23, each of which is located at a slight distance from the longitudinal edges of the area elements 22.

The distance between the shorter edges of the area elements 22 is selected as in the embodiment illustrated in FIG. 5.

Figure 7:
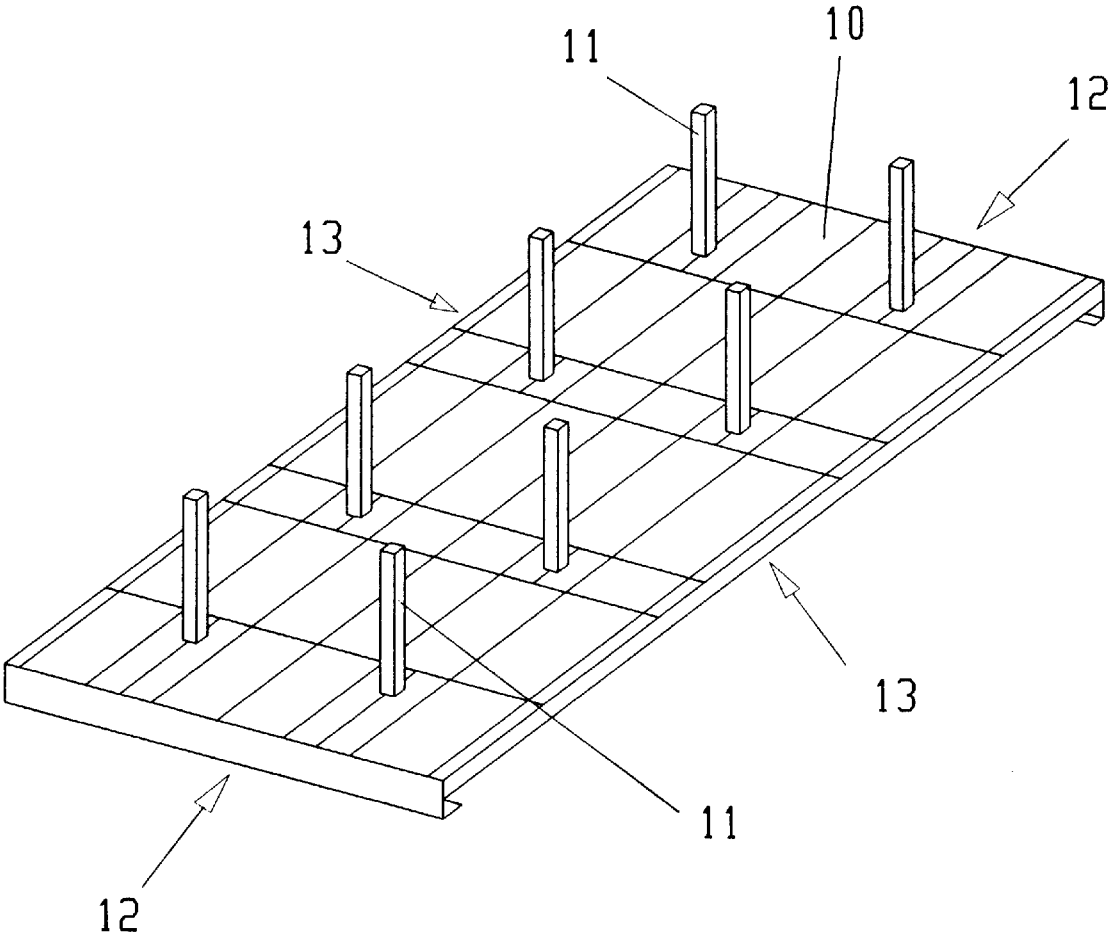
FIG. 7 is a perspective view of a large-area module, in which a single area element forms the entire horizontal surface.

FIG. 7 shows an individual area element 10 which is significantly larger than the area elements illustrated in FIGS. 1 to 4 and is located in the form of a single area element in a horizontal plane, thereby creating a surface which can be used for stowing cargo or for fastening equipment. This area element 10 is therefore in contrast to the area elements illustrated in FIG. 1 to 4 in that it is not connected to additional area elements by means of its edges, but is connected directly or indirectly to the hull of the ship.

The area of the area element 10 is approximately 15 m×6 m.

Corresponding to the area element 10 are a total of eight supporting columns 11 which are distributed in a regular grid pattern over the surface of the area element 10. None of the supporting columns 11 is thereby located in the vicinity of the edges of the area element 10. All the supporting columns 11 are offset inward from the peripheral area of the area element 10 and are located at some distance from its edges.

The distance between the supporting columns 11 and the shorter edges 12 of the area element 10 is approximately 1.5 m, while the distance between the supporting columns 11 and the longer edges 13 of the area element 10 is approximately 1 m.

The length of the supporting columns 11 is approximately 3 m, whereby these supporting columns 11, only the upper portion of which is visible in FIG. 7, extend through the area element 10.

The portion of the supporting columns 11 which extends above the area element 10 is approximately 2 m long, while the portion of the supporting columns 11 which extends below the area element 10 is approximately 1 m long.

Since all the supporting columns 11 are offset inwardly with respect to the edge of the area element 10, the area element 10 can be subsequently adapted in all its peripheral areas to the space conditions which are present in the hull of the ship.

Analogous to FIG. 3, a plurality of area elements 10 can be located one on top of another.

Figure 8:
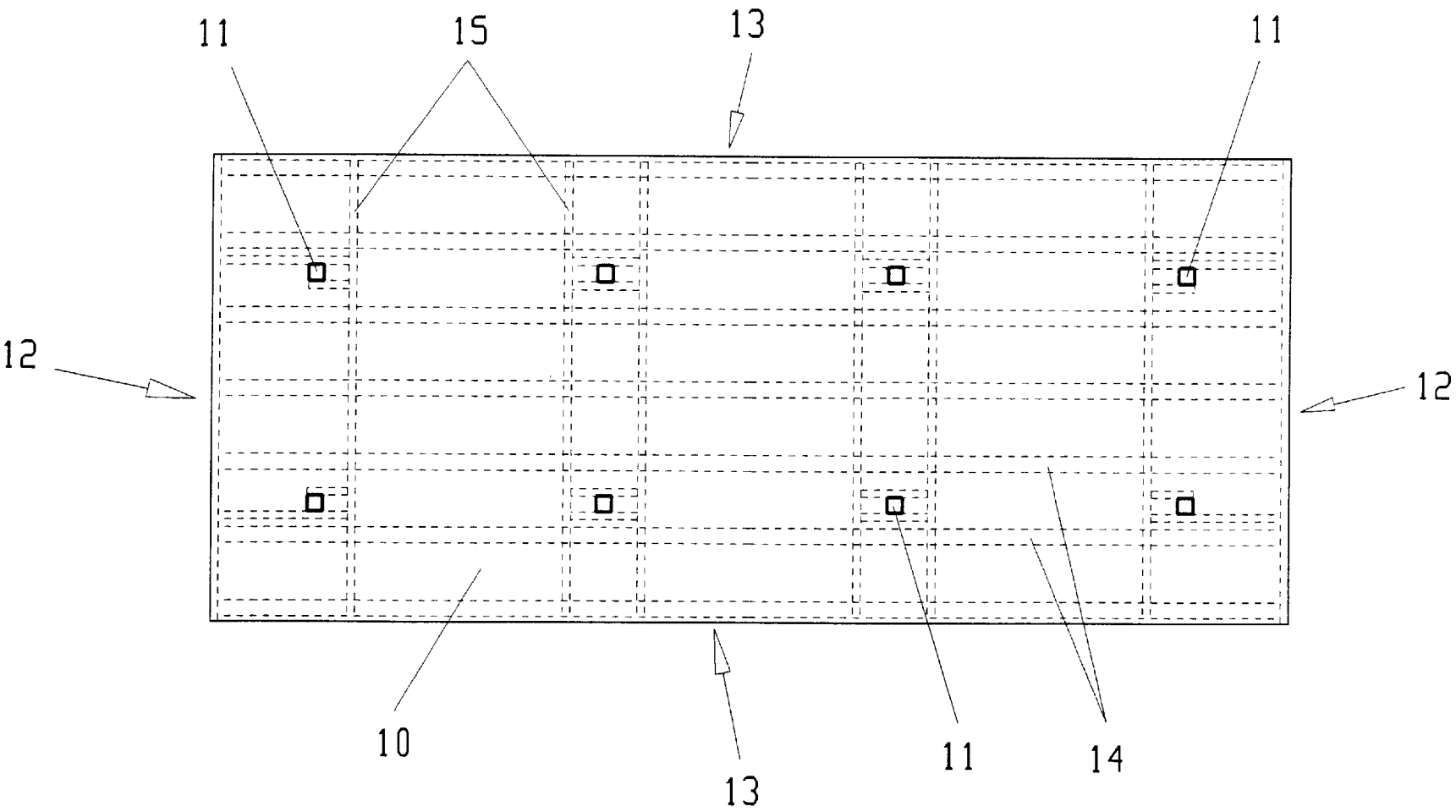
FIG. 8 is an overhead view of an area element as illustrated in FIG. 7.

FIG. 8 is an overhead view which shows an area element 10 as illustrated in FIG. 7.

In addition to the area element 10 which has eight supporting columns 11 as illustrated in FIG. 7, FIG. 8 shows the deck girders 14, 15 which are provided to reinforce and increase the rigidity of the area element 10.

The deck girders 14 run at regular intervals to one another and are parallel to the longer edges 13 of the area element 10.

The deck girders 15, which can be provided only on one side or on both sides of the supporting columns 11, run perpendicular to the deck girders 14; in other words, they run parallel to the shorter edges 12 of the area element 10.

Figure 9:
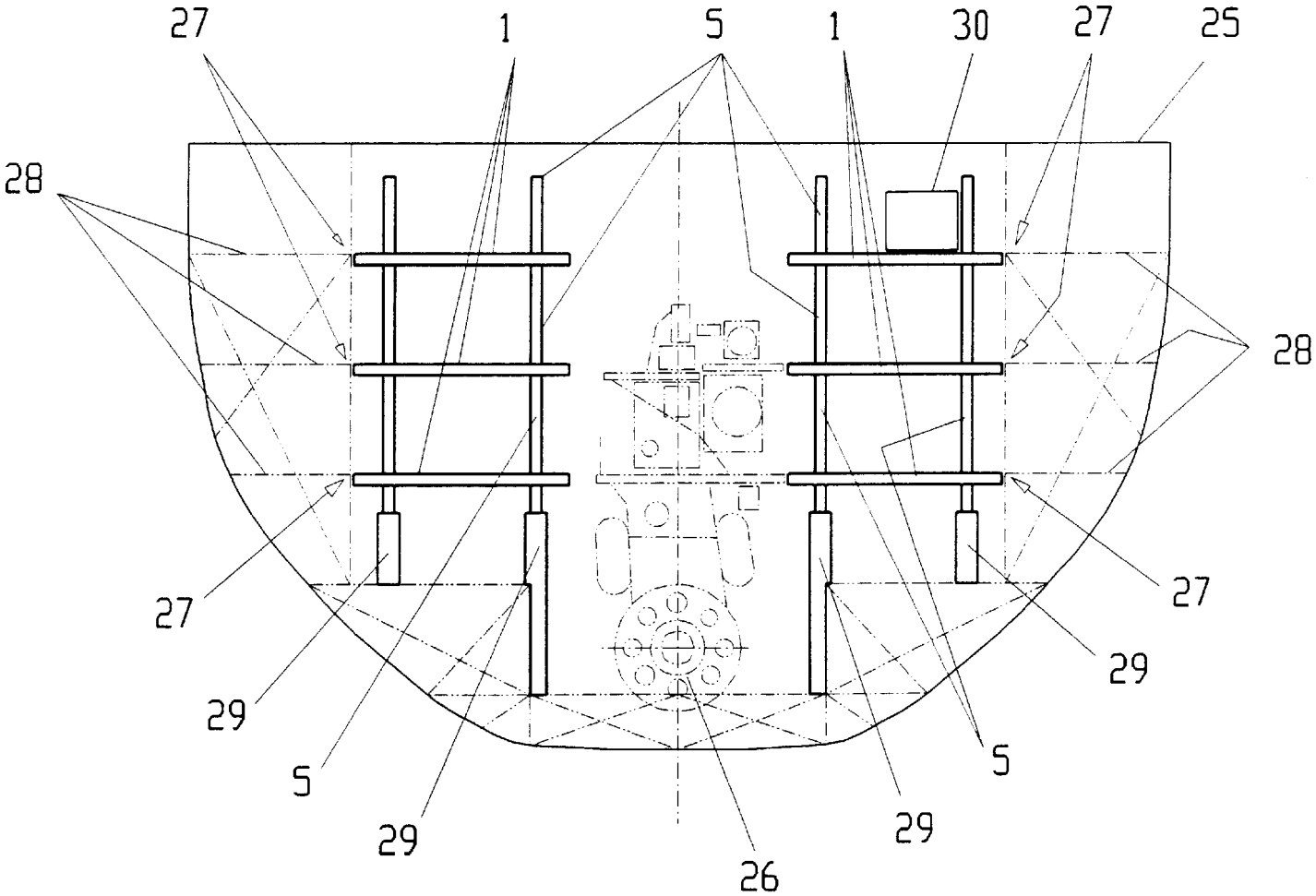
FIG. 9 is a vertical section through a ship.

FIG. 9 shows a vertical section through a ship in accordance with the present invention, which shows how a system like the one illustrated in FIG. 3 including area elements 1 and supporting columns 5 can be installed in the hull 25 of a ship. Equipment module 30 is installed on an area element 1.

Two systems, each of which consists of three area elements 1 stacked on top of one another, are installed to the left and right respectively of the ship's engine.

Laterally, the area elements 1 are connected at 27 with corresponding lateral edges of the ship's decks 28 which are located above one another, so that horizontal forces which occur are transmitted into the deck 28 and into the hull of the ship 25.

The supporting columns 5 of the lowermost area element 1 are supported on appropriate base elements 29 which are located in the hull 25 of the ship.

Figure 10:
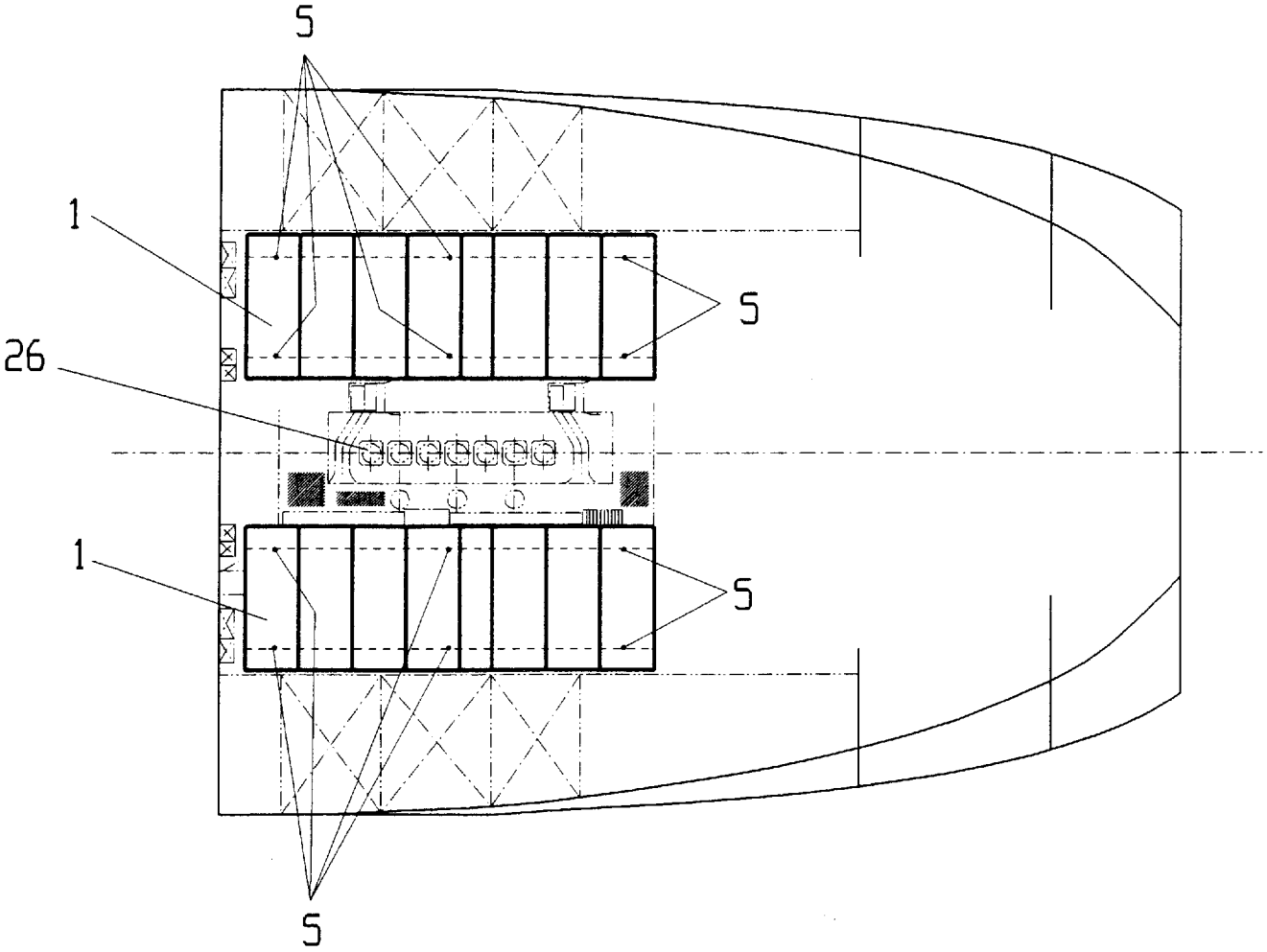
FIG. 10 is a horizontal section through a ship.

FIG. 10 shows a system like the one illustrated in FIG. 9, in a horizontal section.

The figure shows the respective uppermost area elements 1, which are located respectively left and right of the ship's engine 26. There are six supporting columns 5 corresponding to each area element 1.

FIGS. 9 and 10 show that the area elements in accordance with the present invention can be easily and individually adapted to the conditions in the ship's hull, whereby account can thereby be taken of the space available. For example, the space shown in FIGS. 9 and 10 between the ship's engine and the hull 25 can easily be equipped with horizontal surfaces which are located one above another, and on which additional items of equipment can be fastened, for example.

One feature of the invention resides broadly in the ship with supporting columns 5, 11, 21, 23 which run vertically and are located in the hull of the ship, and at least one area element 1, 6, 7, 10, 20, 22 which has corner points, extends horizontally and is mounted on these supporting columns, characterized by the fact that the supporting columns 5, 11, 21, 23 are located at some distance from the corner points of the area element 1, 6, 7, 10, 20, 22.

Another feature of the invention resides broadly in the ship characterized by the fact that the area element 1, 6, 7, 10, 20, 22 is rectangular and is in particular plane.

Yet another feature of the invention resides broadly in the ship characterized by the fact that the supporting columns 5, 11, 21, 23 extend through the area element 1, 6, 7, 10, 20, 22.

Still another feature of the invention resides broadly in the ship characterized by the fact that the area element 1, 6, 7, 10, 20, 22 is mounted on the supporting columns 5, 11, 21, 23 in the lower half of the columns.

A further feature of the invention resides broadly in the ship characterized by the fact that the area element 1, 6, 7, 10, 20, 22 is mounted on the supporting columns 5, 11, 21, 23 at a level of approximately ⅓ of the total height of the columns.

Another feature of the invention resides broadly in the ship characterized by the fact that the area element 1, 6, 7, 10, 20, 22 is mounted on the top or bottom end of the supporting columns.

Yet another feature of the invention resides broadly in the ship characterized by the fact that the height of the supporting columns 5, 11, 21, 23 holding the area element 1, 6, 7, 10, 20, 22 is between 1 m and 5 m, preferably between 2 m and 4 m, and in particular approximately 3 m.

Still another feature of the invention resides broadly in the ship characterized by the fact that the distance between the individual supporting columns 5, 11, 21, 23 is between 1 m and 5 m, preferably between 2 m and 4 m, and in particular approximately 3 m.

A further feature of the invention resides broadly in the ship characterized by the fact that on the underside of the area element 1, 6, 7, 10, 20, 22 there are a plurality of deck girders 9, 14, 15 which run generally horizontally and are in particular parallel to one another and at some interval from one another.

Another feature of the invention resides broadly in the ship characterized by the fact that the distance between two neighboring deck girders 9, 14, 15 is between 0.5 m and 1.5 m, preferably between 0.7 m and 1.3 m, and in particular approximately 1 m.

Yet another feature of the invention resides broadly in the ship characterized by the fact that the deck girders 9, 14, 15 are made of Holland-type bulb plates.

Still another feature of the invention resides broadly in the ship characterized by the fact that edges 2, 3, 12, 13, in particular all the edges 2, 3, 12, 13 of the area element 1, 6, 7, 10, 20, 22, are connected to structural shapes 4, in particular I-beams, the connecting webs of which run horizontally and the transverse webs of which run vertically.

A further feature of the invention resides broadly in the ship characterized by the fact that the bottom and top ends of the supporting columns 5, 11, 21, 23 are realized so that they can be connected with the top of bottom ends respectively of additional supporting columns 5, 11, 21, 23.

Another feature of the invention resides broadly in the ship characterized by the fact that a plurality of area elements 1, 6, 7, 10, 20, 22 including the corresponding supporting columns 5, 11, 21, 23 are located above one another and at some distance from one another.

Yet another feature of the invention resides broadly in the ship characterized by the fact that the edges 2, 3, 12, 13 of the area element 1, 6, 7, 10, 20, 22 which are next to the hull of the ship or a deck are connected to the latter non-positively, at least in some areas.

Still another feature of the invention resides broadly in the ship characterized by the fact that in the vicinity of a horizontal plane there are a plurality of area elements 1 which are adjacent to one another with their edges 2, 3.

A further feature of the invention resides broadly in the ship characterized by the fact that neighboring area elements 1 which are adjacent to one another with their edges 2, 3 are connected non-positively to one another by means of these edges.

Another feature of the invention resides broadly in the ship characterized by the fact that the support columns 5 are located in the vicinity of the edges 2, 3 of the rectangular area elements 1.

Yet another feature of the invention resides broadly in the ship characterized by the fact that corresponding to each area element 1 there are two or four supporting columns 5.

Still another feature of the invention resides broadly in the ship characterized by the fact that all the area elements 1 are essentially the same size as one another.

A further feature of the invention resides broadly in the ship characterized by the fact that two supporting columns 5 are always located on the longer edges 3 of the area element 1.

Another feature of the invention resides broadly in the ship characterized by the fact that the distance between two supporting columns 5 located on one of the longer edges 3 of the area element 1 is approximately one-half the length of the longer edge 3.

Yet another feature of the invention resides broadly in the ship characterized by the fact that the distance between the end of one of the longer edges 3 of the area element 1 or a corner of the area element 1 and the neighboring supporting column 5 located on a longer edge 3 of the area element 1 is approximately one-fourth of the length of the longer edge 3.

Still another feature of the invention resides broadly in the ship characterized by the fact that there is only one single area element 10, 20, 22, which is supported by a plurality of supporting columns 11 which are arranged in a regular grid pattern.

A further feature of the invention resides broadly in the ship characterized by the fact that the supporting columns 11 are located at some distance from the edges 12, 13 of the rectangular area element 10, 20, 22.

Another feature of the invention resides broadly in the ship characterized by the fact that the distance between the edges 12, 13 of the rectangular area element 10, 20, 22 and all the supporting columns 11, 21, 23 next to it is between 0.5 m and 2.5 m, in particular between 1 m and 1.5 m.

Yet another feature of the invention resides broadly in the ship characterized by the fact that the upper sides and/or the undersides of the area elements 1, 6, 7, 20, 22 and of the area element 1 can be used to fasten equipment.

The following U.S. patents, which show examples of modular ships' systems, namely: U.S. Pat. No. 4,711,193 issued to Latza and Mock; U.S. Pat. No. 4,678,439 issued to Schlichthorst; U.S. Pat. No. 4,630,561 issued to Franz, et al.; U.S. Pat. No. 4,579,073 issued to Sadler and Schmidt; and U.S. Pat. No. 4,561,372 issued to Franz, et al., as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

U.S. Pat. No. 5,732,644 filed on Aug. 16, 1996, entitled "Device for the Exhaust and Ventilation System on Ships", and the corresponding foreign patent publication applications, namely, Federal Republic of Germany Patent Application No. 195 30 362.8-22, filed on Aug. 18, 1995, having inventor Günther Sell, and DE-OS 195 30 362.8-22 and DE-PS 195 30 362.8-22, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

Examples of ships and ship's systems and components associated therewith which may be used in conjunction with embodiments of the present invention may be found in the following U.S. Patents: U.S. Pat. No. 5,409,343, issued to Friedrich; U.S. Pat. No. 5,393,020, issued to Perrault and Perrault; U.S. Pat. No. 5,259,332, issued to Ishikawajima, et al.; and U.S. Pat. No. 5,215,026, issued to Windelberg and Cravaack.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. P 195 32 107.3-22, filed on Aug. 30, 1995, having inventors Günther Sell, Hermann Herkens, and Johann Wilts, and DE-OS P 195 32 107.3-22 and DE-PS P 195 32 107.3-22, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clause are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. A ship comprising:

a hull;

said hull having a longitudinal axis defining a longitudinal direction parallel to said axis;

a plurality of decks, said plurality of decks being disposed within said hull;

at least one support column;

said at least one support column being substantially vertical;

at least one equipment module;

at least one of said plurality of decks comprising at least one area element, said at least one area element being a base for said at least one equipment module;

said at least one area element being disposed substantially transverse to said at least one support column;

said at least one area element having first and second edges;

said first and second edges being substantially parallel to said longitudinal axis;

said at least one area element having third and fourth edges, said third and fourth edges being substantially transverse to said first and second edges; and said at least one support column is disposed in contact with said at least one area element a sufficient distance from said third edge and said fourth edge to form a peripheral area of said at least one area element free from said at least one support column, to allow said at least one area element to be adapted to the spatial conditions within said ship by trimming.

2. The ship according to claim 1 wherein:

said at least one area element comprises a top surface and a bottom surface facing away from one another, said bottom surface being disposed toward said hull of said ship;

at least one of said top surface and said bottom surface of said at least one area element being configured to store equipment aboard said ship;

said first and second edges are parallel to each other;

each of said first and second edges has a length;

said lengths of said first and second edges are equal to one another;

said third and fourth edges are parallel to each other;

each of said third and fourth edges has a length;

said lengths of said third and fourth edges are equal to one another; and said third and fourth edges are transverse to said first and second edges.

3. The ship according to claim 2 wherein said at least one support column comprises a first end and a second end, said first and second ends being a substantial distance apart.

4. The ship according to claim 3 wherein:

said at least one area element is disposed as is set forth in one of a); b) and c):

a) a substantial distance from said first and second ends of said at least one support column, said substantial distance being about ⅓ of the distance between said second end and said first end;

b) adjacent said first end of said at least one support column; and c) adjacent said second end of said at least one support column.

5. The ship according to claim 4 wherein:

said at least one support column has a length extending between said first end and said second end; and said length of said at least one support column is between about 1 meter and about 5 meters.

6. The ship according to claim 5 wherein:

said at least one support column comprises a plurality of support columns, each of said plurality of support columns being disposed a distance from an adjacent one of said plurality of support columns; and said distance between adjacent ones of said plurality of support columns is between about 1 meter and about 5 meters.

7. The ship according to claim 6 comprising:

a plurality of deck girders;

said plurality of deck girders being disposed on said bottom of said at least one area element;

each of said plurality of deck girders being disposed substantially parallel to one another; and each of said plurality of deck girders being substantially parallel to said at least one area element.

8. The ship according to claim 7 wherein:

each of said plurality of deck girders is disposed a distance from an adjacent one of said plurality of deck girders; and said distance between adjacent ones of said plurality of deck girders is between about 0.5 meters and about 1.5 meters.

9. The ship according to claim 8 wherein:

said length of said at least one support column is about 3 meters;

said distance between adjacent ones of said plurality of support columns is about 3 meters; and said distance between adjacent ones of said plurality of deck girders is about 1 meter.

10. The ship according to claim 9 wherein said plurality of deck girders comprise Holland-type bulb plates.

11. The ship according to claim 10 comprising:

a plurality of I-beams; and said plurality of I-beams being disposed adjacent said at least one area element for supporting said at least one area element.

12. The ship according to claim 11 wherein:

said first And second ends of each of said plurality of support columns comprise means for connecting to another of said plurality of support columns;

said at least one area element comprises a plurality of area elements; and said plurality of area elements comprises area elements disposed adjacent one another, said adjacent area elements being disposed a vertical distance from one another.

13. The ship according to claim 12 wherein a portion of said plurality of area elements are disposed adjacent said hull to be connected to said hull.

14. The ship according to claim 13 wherein:

said plurality of area elements comprise area elements coplanar with one another; and said coplanar area elements are disposed in contact with other area elements in the same plane.

15. The ship according to claim 14 wherein:

said plurality of support columns are disposed adjacent said first and second edges of said plurality of area elements;

each of said plurality of area elements has a length, said length being parallel to said first edge;

each of said plurality of area elements has a width, said width being parallel to said third edge; and each of said plurality of area elements has substantially the same width and substantially the same length as the remainder of said plurality of area elements.

16. The ship according to claim 15 wherein said plurality of support columns comprises two of said support columns disposed adjacent each of said plurality of area elements.

17. The ship according to claim 15 wherein said plurality of support columns comprises four of said support columns disposed adjacent each of said plurality of area elements.

18. The ship according to claim 17 wherein:

a first one of said support columns is disposed adjacent said first edge of each of said plurality of area elements, said support column being disposed at about ¼ of the length of said area element from said third edge of each of said plurality of area elements;

a second one of said support columns is disposed adjacent said first edge of each of said plurality of area elements, said support column being disposed at about ¼ of the length of said area element from said fourth edge of each of said plurality of area elements;

a third one of said support columns is disposed adjacent said second edge of each of said plurality of area elements, said support column being disposed at about ¼ of the length of said area element from said third edge of each of said plurality of area elements; and a fourth one of said support columns is disposed adjacent said second edge of each of said plurality of area elements, said support column being disposed at about ¼ of the length of said area element from said fourth edge of each of said plurality of area elements.

19. The ship according to claim 11 wherein:

said at least one area element comprises a sole area element;

said area element is supported by said plurality of support columns;

said plurality of support columns are disposed in a rectangular pattern adjacent said bottom surface of said area element; and each of said plurality of support columns is disposed between 0.5 meters and 2.5 meters from the nearest one of said first, second, third and fourth edges of said area element.

20. The ship according to claim 19 wherein each of said support columns is disposed between about 1 meter and about 1.5 meters from the nearest one of said first, second, third and fourth edges of said area element.

* * * * *

UNITED STATES PATENT AND TRADEMARK OFFICE

CERTIFICATE OF CORRECTION

PATENT NO. : 5,899,161

DATED : May 4, 1999

INVENTOR(S) : Günther SELL, Hermann HERKENS, and Johann WILTS

It is certified that error appears in the above-indentified patent and that said Letters Patent is hereby corrected as shown below:

On the title page, after 'Attorney, Agent, or Firm-', delete "Niles" and insert --Nils--.

Signed and Sealed this

Twenty-eighth Day of December, 1999

*Attest:*

Q. TODD DICKINSON

*Attesting Officer*

*Acting Commissioner of Patents and Trademarks*